US007309954B2

(12) United States Patent
Song et al.

(10) Patent No.: US 7,309,954 B2
(45) Date of Patent: Dec. 18, 2007

(54) FIELD EMISSION DISPLAY HAVING GATE PLATE

(75) Inventors: Yoon Ho Song, Daejeon-Shi (KR); Chi Sun Hwang, Daejeon-Shi (KR); Choong Heui Chung, Daejeon-Shi (KR); Jin Ho Lee, Daejeon-Shi (KR)

(73) Assignee: Electronics and Telecommunications Research Institute (KR)

( * ) Notice: Subject to any disclaimer, the term of this patent is extended or adjusted under 35 U.S.C. 154(b) by 56 days.

(21) Appl. No.: 10/745,736

(22) Filed: Dec. 23, 2003

(65) Prior Publication Data

US 2004/0160161 A1 Aug. 19, 2004

(30) Foreign Application Priority Data

Dec. 24, 2002 (KR) ..... 10-2002-0083754
Apr. 2, 2003 (KR) ..... 10-2003-0020781

(51) Int. Cl.
*H01J 1/62* (2006.01)

(52) U.S. Cl. ..... 313/495; 313/293

(58) Field of Classification Search ..... 313/293–304, 313/495–497; 315/169.1, 169.3, 169.4; 345/75.2; 257/347, 72, 57, 350, 351, 347.72
See application file for complete search history.

(56) References Cited

U.S. PATENT DOCUMENTS 5,015,912 A 5/1991 Spindt et al.
5,402,041 A 3/1995 Kishino et al.
5,448,133 A * 9/1995 Ise ..... 313/497
5,528,103 A * 6/1996 Spindt et al. ..... 313/497
5,599,749 A * 2/1997 Hattori ..... 216/11

(Continued)

FOREIGN PATENT DOCUMENTS

JP 06-044927 2/1994
JP 07-104679 4/1995
JP 07-335117 12/1995

(Continued)

OTHER PUBLICATIONS

R. Baptist, F. Bachelet, C. Constancias, Microtips and Resistive Sheet: A Theoretical Description of the Emissive Properties of this System, 9th International Vacuum Microelectronics Conference, St. Petersburg, 1996, pp. 23.

(Continued)

*Primary Examiner*—Vip Patel
(74) *Attorney, Agent, or Firm*—Blakely, Sokoloff, Taylor & Zafman

(57) ABSTRACT

The present invention relates to a field emission display in which a gate plate having a gate hole and a gate electrode around the gate hole is formed between an anode plate having phosphor and a cathode plate having a field emitter and a control device for controlling field emission current, wherein the field emitter of the cathode plate is constructed to be opposite to the phosphor of the anode plate through the gate hole.

According to the present invention, it is possible to significantly reduce the display row/column driving voltage by applying scan and data signals of the field emission display to the control device of each pixel, And the present invention is directed to improve the brightness of the field emission display in such a manner that the electric field necessary for field emission is applied through the gate electrode of the gate plate to freely control the distance between the anode plate and the cathode plate, so that a high voltage can be applied to the anode.

20 Claims, 8 Drawing Sheets

U.S. PATENT DOCUMENTS

| | | | | |
|---|---|---|---|---|
| 5,616,991 | A | 4/1997 | Casper et al. | |
| 5,821,679 | A * | 10/1998 | Makishima | 313/310 |
| 5,939,833 | A * | 8/1999 | Song et al. | 315/169.1 |
| 6,204,608 | B1 * | 3/2001 | Song et al. | 315/169.3 |
| 6,307,323 | B1 * | 10/2001 | Song et al. | 315/169.1 |
| 2002/0011777 | A1 * | 1/2002 | Konishi et al. | 313/495 |
| 2002/0080099 | A1 * | 6/2002 | Song et al. | 345/75.2 |
| 2003/0011317 | A1 * | 1/2003 | Koyama | 315/169.3 |

FOREIGN PATENT DOCUMENTS

| | | |
|---|---|---|
| JP | 10-283958 | 10/1998 |
| JP | 2001-076652 | 3/2001 |
| JP | 2001-084927 | 3/2001 |
| JP | 2001-155667 | 6/2001 |
| JP | 2001-167720 | 6/2001 |
| JP | 2001-222967 | 8/2001 |
| JP | 2001-266737 | 9/2001 |
| JP | 2001-357773 | 12/2001 |
| JP | 2002-297083 | 10/2002 |
| JP | 2002-343281 | 11/2002 |
| JP | 2003-016913 | 1/2003 |
| KR | 2000-0034644 | 6/2000 |
| KR | 10-0363219 | 12/2002 |

OTHER PUBLICATIONS

W.B. Choi, D.S. Chung, S.H. Park, J.M. Kim, Late-News Paper: A 4.5-in. Fully Sealed Carbon Nanotube-Based Field-Emission Flat-Panel Display, Samsung Advanced Institute of Technology, Suwon, Korea SID 99 Digest, pp. 1134-1137.

* cited by examiner

FIELD EMISSION DISPLAY HAVING GATE PLATE

BACKGROUND OF THE INVENTION

1. Field of the Invention

The present invention relates to a field emission display (FED) in which the field emission device is applied to a flat display, and in particular, to the field emission display in which a gate plate having a gate hole and a gate electrode around the gate hole is formed between an anode plate having phosphor and a cathode plate having a field emitter and a control device for controlling field emission current, wherein the field emitter of the cathode plate is constructed to be opposite to the phosphor of the anode plate through the gate hole.

2. Background of the Related Art

A field emission display is a device representing an image through cathodeluminescence of a phosphor, by colliding electron emitted from the field emitter of a cathode plate against the phosphor of an anode plate, wherein the cathode plate having the field emitter and the anode plate with the phosphor are formed to be opposite to each other by vacuum packaging with them separated by a given distance (for example, 2 mm). Recently, many researches and developments have been made on the field emission display as the flat display capable of replacing the conventional cathode ray tube (CRT). Electron emission efficiency in the field emitter being a kernel constitutional element of the field emission display is variable depending on a device structure, an emitter material and a shape of the emitter.

The structure of the field emission device can be mainly classified into a diode type having the cathode (or emitter) and the anode, and a triode having the cathode, the gate and the anode. Metal, silicon, diamond, diamond-like carbon, carbon nanotube, and the like are usually used as the emitter material. In general, metal and silicon are manufactured to the triode structure and diamond, carbon nanotube, etc. manufactured to the diode structure.

The diode field emitter is usually formed by making a diamond or a carbon nanotube film-shaped. The diode field emitter has advantages in simplicity of the manufacturing process and high reliability of the electron emission, even though it has disadvantages in controllability of the electron emission and low-voltage driving, compared with the triode field emitter.

Hereinafter, a conventional field emission display having field emitters will be described with reference to the accompanying drawings.

FIG. 1 is a perspective view schematically illustrating the construction of a conventional field emission display having a diode field emitter.

A cathode plate has cathode electrodes 11 arranged in a belt shape on a lower glass substrate 10B and film-shaped field emitter materials 12 on a portion of there. An anode plate has transparent anode electrodes 13 arranged in a belt shape on an upper glass substrate 10T and phosphors 14 of red (R), green (G) and blue (B) on a portion of there. The cathode plate and the anode plate are vacuum packaged in parallel, while facing each other, by means of using spacers 15 as a supporter. The cathode electrodes 11 of the cathode plate and the transparent anode electrodes 13 of the anode plate are arranged to intersect each other. In the above, an intersecting region is defined as one pixel.

In the field emission display shown in FIG. 1, the electric field required for electron emission is given by the voltage difference between the cathode electrodes 11 and the anode electrodes 13. It has been noted that electron emission usually occurs in the field emitter when the electric field is applied to the field emitter material in the value more than 0.1 V/μm.

FIG. 2 shows the field emission display that was proposed in order to improve the disadvantages of the field emission display shown in FIG. 1, which schematically illustrates the construction of a conventional field emission display using a control device for controlling the field emitter in each pixel of the cathode plate.

The cathode plate includes a belt shaped scan signal line 21S and a data signal line 21D, which are formed of a metal on a glass substrate 20B and capable of an electrical row/column addressing, a film (thin film or thick film) shaped field emitter 22, in which each pixel defined by the scan signal line 21S and the data signal line 21D is formed of diamond, diamond-like carbon, carbon nanotube, etc., and control devices 23 connected to the scan signal line 21S, the data signal line 21D and the field emitter 22 to control a field emission current depending of the scan and the data signals of the display. The anode plate includes transparent anode electrodes 24 arranged in a belt shape on a glass substrate 20T and phosphors 25 of red (R), green (G) and blue (B) on a portion of there. The cathode plate and the anode plate are vacuum packaged in parallel, while facing each other, by means of using spacers 26 as a supporter.

In the field emission display shown in FIG. 2, a high voltage is applied to the anode electrodes 24 to induce electron emission from the film-shaped field emitter 22 in the cathode plate and to accelerate the emitted electrons with high energy at the same time. Then, if a signal of the display is inputted to the control devices 23 through the scan signal line 21S and the data signal line 21D, the control device 23 controls the amount of electrons emitted from the film-shaped field emitter to represent row/column images.

The diode field emitter used for the field emission displays shown in FIG. 1 and FIG. 2, as described above, has advantages that a structure is simple and a manufacturing process is easy, since it does not need a gate and a gate insulating film unlike a conic triode field emitter.

Further, the diode field emitter has very low probability in the breakdown of the field emitter by the sputtering effect upon emission of the electrons, so that it has a high reliability and there is no breakdown phenomenon of the gate and the gate insulator that is very problematic in the triode field emitter.

In the field emission display having the diode field emitter shown in FIG. 1, however, a high electric field necessary for field emission is applied through the electrodes (cathode electrodes 11 and transparent anode electrodes 13 in FIG. 1) of the upper and lower plates that are separated by a significant distance (usually, 200 μm to 2 mm), so that a display signal having high voltage is required. As a result, there is a disadvantage that an expensive high voltage driving circuit is required.

In particular, in the field emission display having the diode field emitter of FIG. 1, although the voltage necessary for electron emission is lowered by reducing the distance between the upper plate and the lower plate, low voltage driving is nearly impossible since the anode electrode 13 is used as the acceleration electrode of the electron as well as the signal line of the display. In the field emission display, a high-energy electron over 200 eV is required to emit the phosphor. The higher electron energy is, the better luminous efficiency is. Thus, a high-brightness field emission display can be obtained only if the high voltage is applied to the anode electrode.

In the conventional active-matrix field emission display having the diode field emitter shown in FIG. 2, the control device 23 of the field emitter is used in each pixel and, by inputting the display signal through it, the active-matrix field emission display can solve the high voltage driving problem in FIG. 1 and the problems such as non-uniformity of electron emission, cross talk, etc. at the same time. The high voltage applied to the anode electrode 24 for the field emission and electron acceleration, however, comes to induce a significant voltage to the control devices 23 of each pixel. And, if the voltage is induced more than the breakdown voltage of the control devices 23, the control device could be failed.

Therefore, the conventional active-matrix field emission display has disadvantages that the voltage that can be applied to the anode electrodes 24 is limited depending on the breakdown characteristics of the control devices 23 and it is difficult to fabricate the field emission display having the high brightness due to the limited anode voltage.

SUMMARY OF THE INVENTION

Accordingly, the present invention has been made in view of the above problems, and the present invention is directed to significantly reduce the display row/column driving voltage by applying scan and data signals of the field emission display to the control device of each pixel.

And the present invention is directed to improve the brightness of the field emission display in such a manner that the electric field necessary for field emission is applied through the gate electrode of the gate plate to freely control the distance between the anode plate and the cathode plate, so that a high voltage can be applied to the anode.

In addition, the present invention is directed to allow the gate plate and the cathode plate to be separately fabricated and then assembled, so that the facilitating process can be readily performed, and the productivity and yield can be improved by fundamentally removing the breakdown of the gate insulating film of the field emitter.

To achieve the above objects, according to one aspect of the present invention, there is provided a field emission display having a gate plate, comprising: an anode plate having a transparent electrode on a substrate and a phosphor on a portion of the transparent electrode; a cathode plate having row/column signal lines of a belt shape for which row/column addressing is possible on the substrate, and pixels each defined by the row signal line and the column signal line, wherein each pixel has a film-shaped field emitter and a control device for controlling the field emitter, having two terminals connected to at least the row/column signal lines and one terminal connected to the film-shaped field emitter; a gate plate having gate holes penetrating therein and a gate electrode around the top of the gate holes; and spacers for supporting the gate plate between the cathode plate and the anode plate, wherein the field emitter of the cathode plate is constructed to be opposite to the phosphor of the anode plate through the gate holes and is formed by vacuum packaging.

In the aforementioned of a field emission display having a gate plate according to another embodiment of the present invention, the anode plate, the cathode plate and the gate plate are preferably formed of different insulating substrates.

In the aforementioned of a field emission display having a gate plate according to another embodiment of the present invention, the spacers are preferably formed between the cathode plate and the gate plate and between the anode plate and the gate plate.

In the aforementioned of a field emission display having a gate plate according to another embodiment of the present invention, the phosphor of each pixel is the phosphor of red (R), green (G) or blue (B).

In addition, in the aforementioned of a field emission display having a gate plate according to another embodiment of the present invention, an optical-shielding film (black matrix) is further formed at a given region between the phosphors of the anode.

Preferably, the field emitter is formed of a thin film or a thick film comprising a diamond, a diamond carbon, or a carbon nanotube, and the control device is a thin film transistor or a metal-oxide-semiconductor field effect transistor.

In the aforementioned of a field emission display having a gate plate according to another embodiment of the present invention, the gate electrode is applied to a DC voltage to induce an electron emission from the film-shaped field emitter in the cathode plate; the emitted electrons are accelerated with high energy by applying the DC voltage to the transparent electrode of the anode plate; and scan and data signals are addressed to the control device of the field emitter in each pixel of the cathode plate, whereby the control device of the field emitter controls the electron emission of the field emitter to represent images.

Further, the gate electrode of the gate plate is applied to the DC voltage in the range of 50 to 1500V and the transparent electrode of the anode plate is applied to the DC voltage of over 2 kV and, the image gray scale is represented by changing the pulse amplitude and/or pulse width (duration) of the data signal voltage applied to the field emitter through controlling of the control device, and the voltage of the data signal applied to the field emitter is preferably the pulse in the range of 0 to 50V In the aforementioned of a field emission display having a gate plate according to another embodiment of the present invention, an electron-convergence electrode is further formed between the cathode plate and the gate plate and, said electron-convergence electrode helps the electrons emitted from the field emitter to be well converged on the phosphor of the anode plate and, further to prohibit the field emission of the field emitter by the anode voltage along with said gate electrode of the gate plate, by applying the constant voltage to said electron-convergence electrode and, said electron-convergence electrode is preferably intended to serve as an optical-shielding film.

In the aforementioned of a field emission display having a gate plate according to another embodiment of the present invention, the field emitter includes dots divided into a plurality of regions and the gate hole of the gate plate has the number corresponding to each of the dots.

In addition, the control device is a thin film transistor, which comprises; a gate made of a metal on the cathode plate; a gate insulating film formed on the cathode plate including the gate; an active layer made of a semiconductor thin film on a portion of the gate and the gate insulating film; a source and a drain formed at both ends of the active layer; and an interlayer insulating layer having a contact hole for connecting the source and the drain to the electrode.

Further, in the field emission display as described above, an electron-convergence electrode made of a metal is further formed on the interlayer insulating layer and, the active layer of the thin film transistor consists of amorphous silicon or a polysilicon layer and, preferably, the interlayer insulating film consists of an amorphous silicon nitride film or a silicon oxide film.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

A field emission display of the present invention is significantly different comparing with that of the prior art field, in a cathode plate and the structure of a gate plate and a method of driving the same. Hereinafter, the field emission display according to the present invention will be described in detail with reference to FIG. 3 to FIG. 8.

Figure 1:
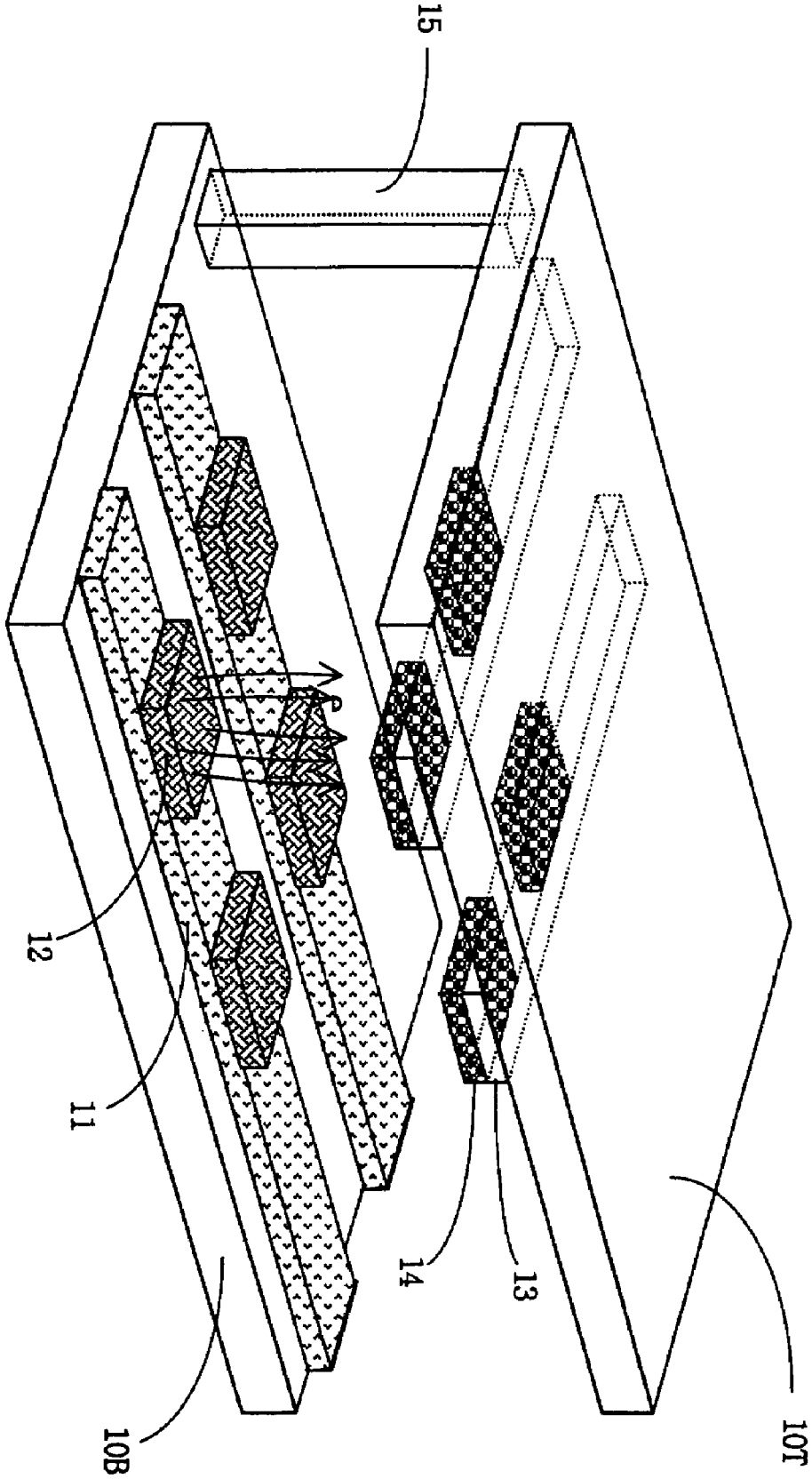
FIG. 1 (PRIOR ART)
FIG. 1 is a perspective view schematically illustrating the construction of a conventional field emission display having a diode field emitter.
Figure 2:
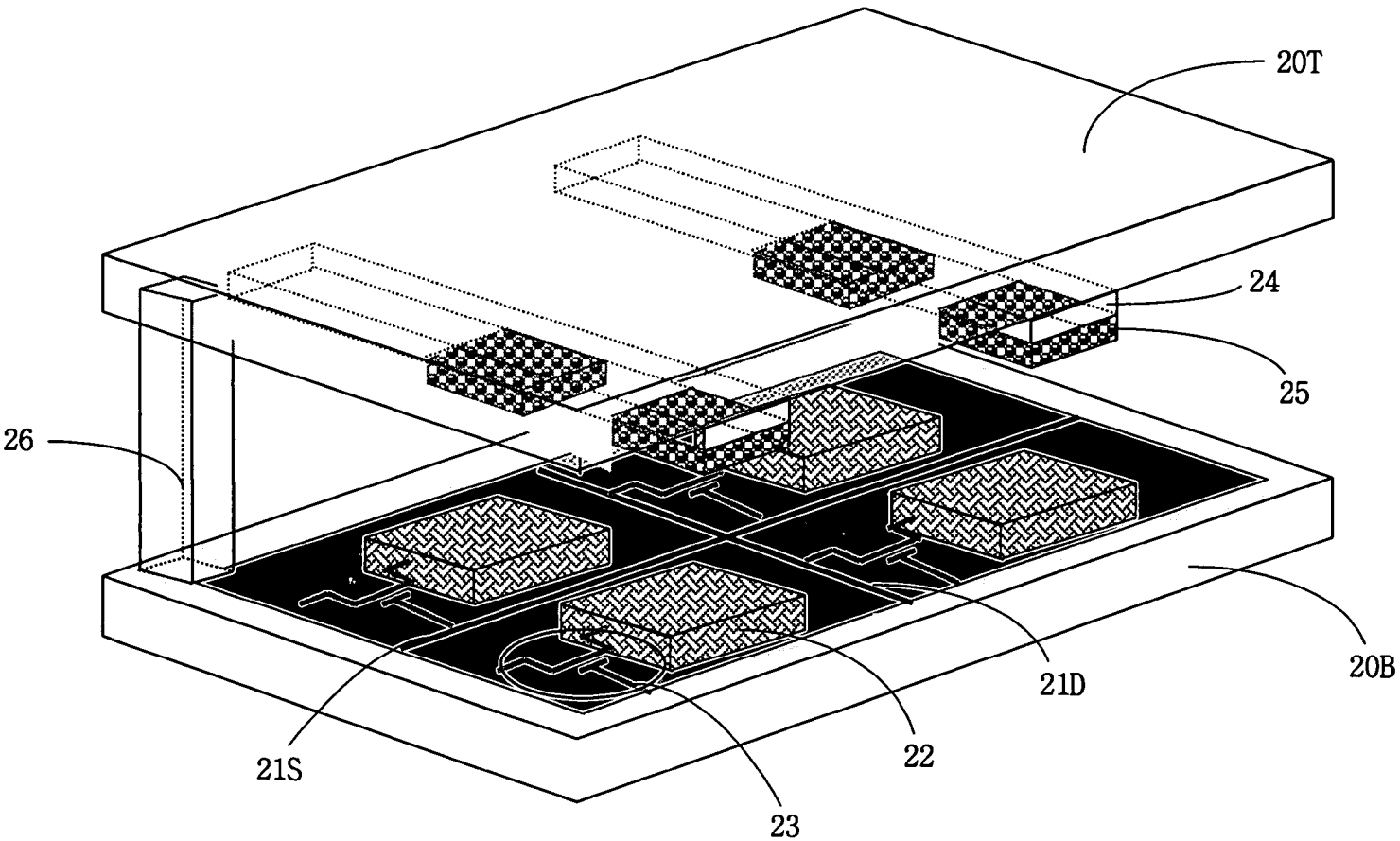
FIG. 2(PRIOR ART)
FIG. 2 is a perspective view schematically illustrating the construction of a conventional active-matrix field emission display having the diode field emitter.
Figure 3:
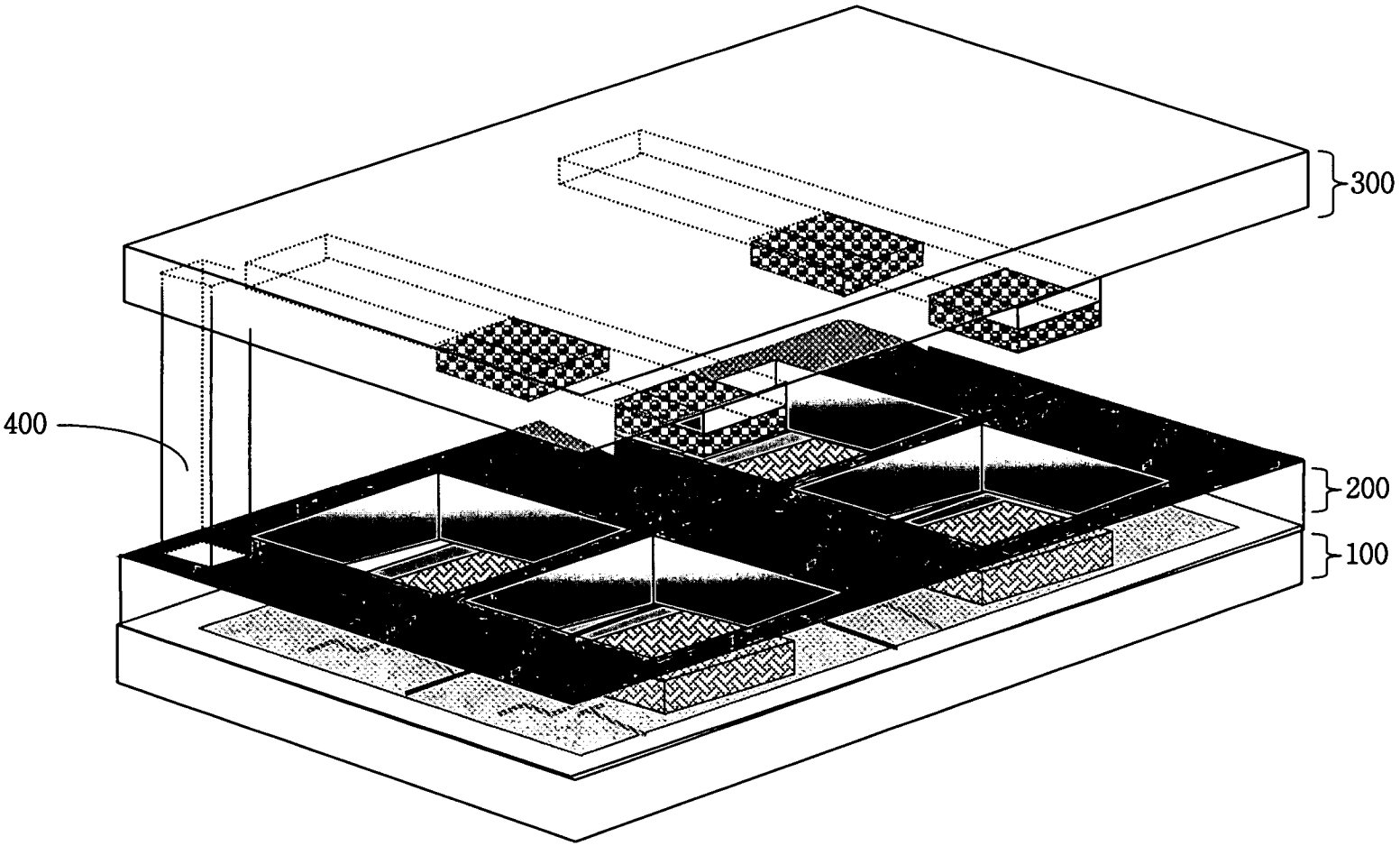
FIG. 3 is a perspective view schematically illustrating the construction of an active-matrix field emission display having a gate plate according to the present invention.
Figure 4:
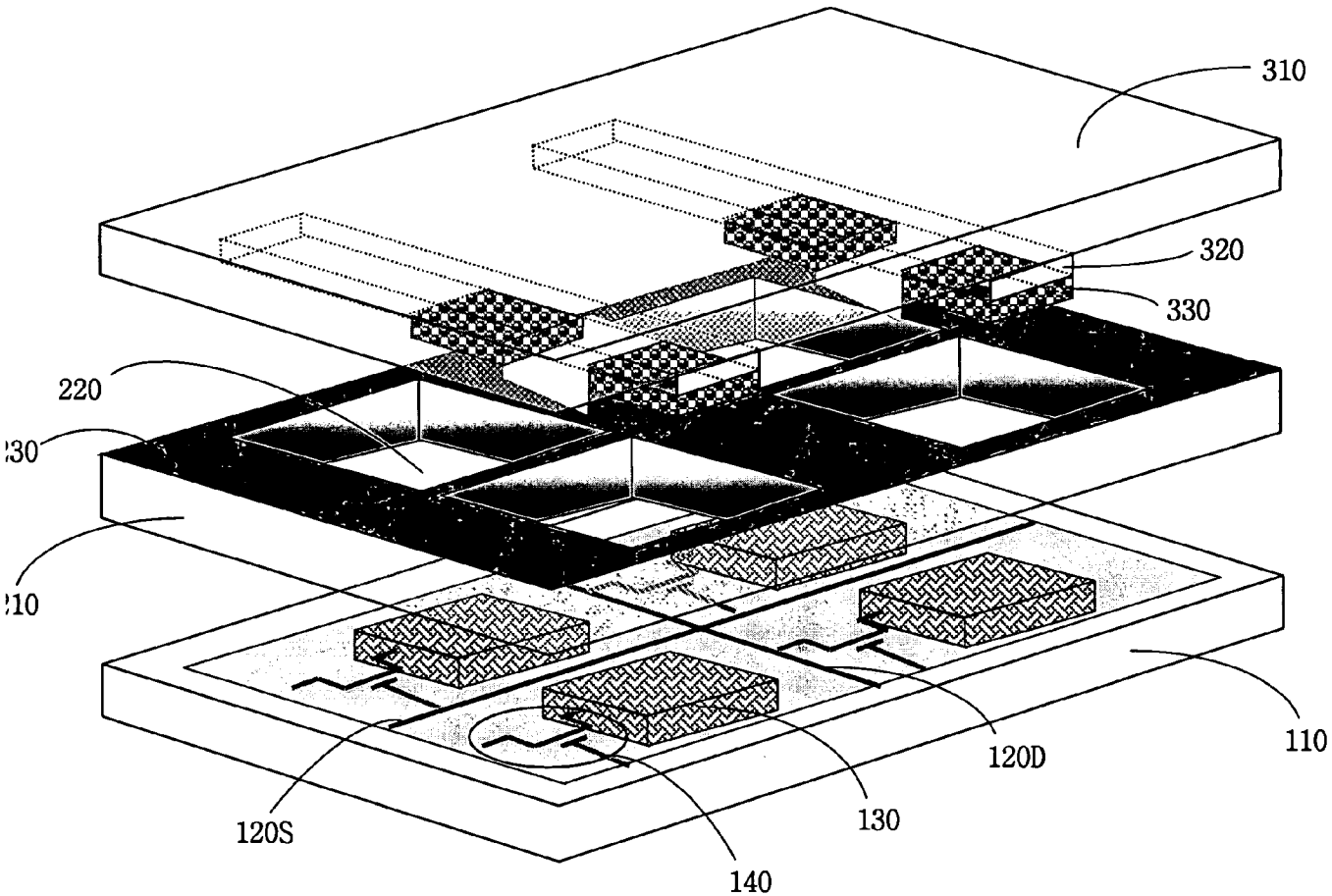
FIG. 4 is a perspective view schematically illustrating a cathode plate, a gate plate and an anode plate in the field emission display according to the present invention.

FIG. 3 is a perspective view schematically illustrating a construction of an active-matrix field emission display having a gate plate according to the present invention and FIG. 4 is a perspective view schematically illustrating a cathode plate, a gate plate and an anode plate in a field emission display according to the present invention. The field emission display includes the cathode plate 100, the gate plate 200 and the anode plate 300.

As shown in FIG. 4, the cathode plate 100 includes a belt shaped row signal line 120S and column signal line 120D on an insulating substrate 110 including glass, plastic, various ceramics, and the like, wherein the belt shaped row signal line and column signal line are made of a metal and enable to a row/column addressing. The unit pixels are defined by the row signal lines 120S and the column signal lines 120D. Each pixel includes a film-shaped (thin film or thick film) field emitter 130 made of diamond, diamond like carbon, carbon nanotube, etc. and a control device 140 of the field emitter. It is preferred that the control device 140 includes two terminals connected to at least the row signal line 120S and the column signal line 120D and one terminal connected to the film-shaped field emitter 130. For example, the control device 140 may be an amorphous thin film transistor, a polysilicon thin film transistor, a metal-oxide-semiconductor field effect transistor, or the like.

The gate plate 200 includes gate holes 220 penetrating a substrate 210, and a gate electrode 230 made of a metal around the gate holes 220. The substrate 210 of the gate plate 200 can be formed by a transparent substrate such as glass, plastic, various ceramics, various transparent insulating substrates, or the like, and if necessary, a non-transparent substrate can be used as the substrate. The thickness of the gate plate 200 may be for example 0.01 to 1.1 mm and the thickness of the gate electrode may be several hundreds of Å to several thousands of Å. The metal used for the gate electrode 230 may be chrome, aluminum, molybdenum, and the like, but not limited thereto. In addition, the gate holes 220 can be formed to be opened a little bit larger than each pixel so that the holes 220 can serve as the aperture of the unit pixel (for example, several tens of μm to several hundreds of μm) formed in the cathode plate 100. Those skilled in the art will appreciate that the size of the gate hole 220, the shape of the section, the thickness of the gate plate 200, the thickness of the gate electrode 230, the shape and distance separated from the field emitter 130, etc. are not specially limited but can be variously modified.

The anode plate 300 includes a transparent electrode 320, and phosphors 330 of red (R), green (G) and blue (B) formed on a portion of the transparent electrode 320, on a transparent insulating substrate 310 made of glass, plastic, various ceramics, etc., as shown in FIG. 4.

Meanwhile, in the cathode plate 100, the gate plate 200 and the anode plate 300, the field emitter 130 of the cathode plate 100 are vacuum packaged parallel to the phosphor 330 of the anode plate 300 through the gate holes 220 of the gate plate 200, while facing each other, by means of using spacers 400 as a supporter, as shown in FIG. 3 and FIG. 4. The spacers 400 can be manufactured by glass beads, ceramics, polymer, etc. and may have a height in the range of approximately 200 μm to 3 mm.

On the other hand, the gate electrode 230 may be also used as an optical-shielding film by selecting the type of a metal used as the gate electrode 230 or the thickness of the film.

Figure 5:
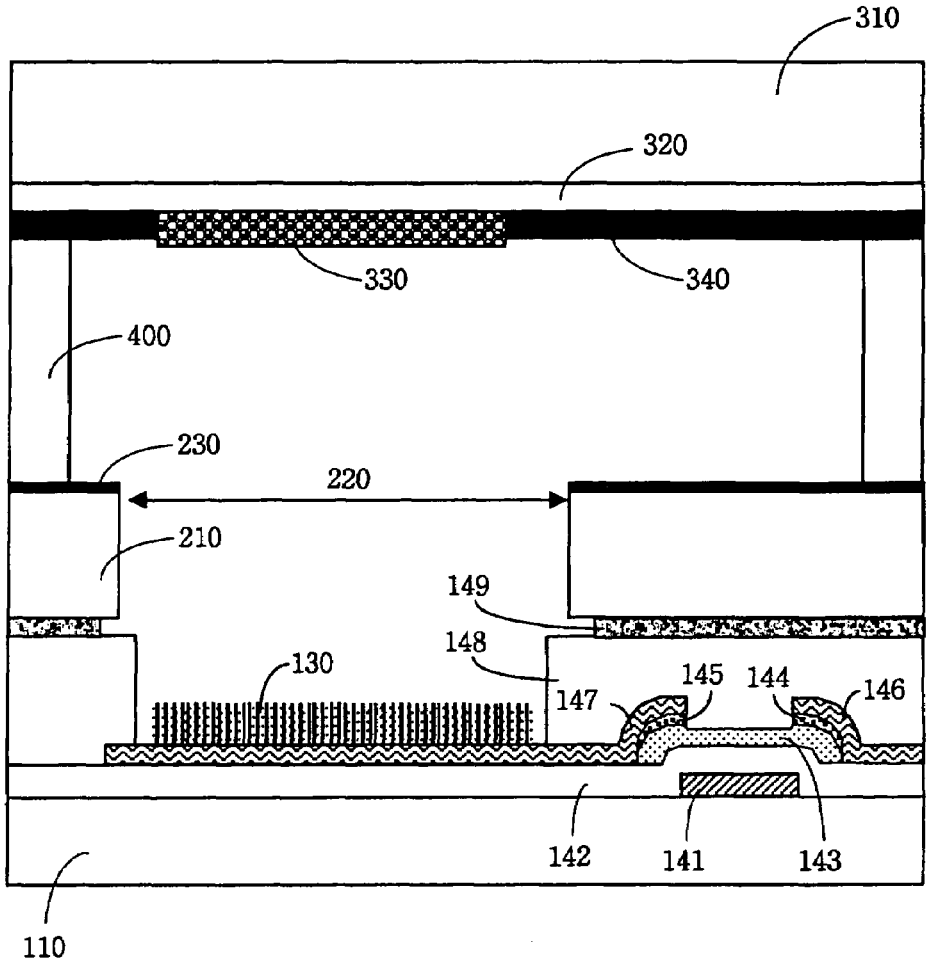
FIG. 5 is a cross-sectional view illustrating a pixel structure of the field emission display according to one embodiment of the present invention.

Next, the method of fabricating the field emission display according to one embodiment of the present invention will be described in detail with reference to FIG. 5. FIG. 5 is a cross-sectional view illustrating the unit pixel of the field emission display according to the present invention.

In an embodiment of FIG. 5, the gate plate is adhered to the cathode plate, while the anode plate is separated and vacuum packaged from the gate plate by the spacer supported between the anode plate and the gate plate. The cathode plate, the gate plate and the anode plate can be fabricated separately and then combined together.

The unit pixel of the field emission display shown in FIG. 5 includes the cathode plate, the gate plate and the anode plate. The cathode plate has the substrate 110, the thin film transistor element, the field emitter, etc.

The thin film transistor element includes a gate 141 made of a metal on the substrate 110, a gate insulating film of the thin film transistor 142 composed of an amorphous silicon nitride (a-SiNx) film or a silicon oxide film on the substrate 110 including the gate 141, an active layer of the thin film transistor 143 formed of amorphous silicon (a-Si) on a portion of the gate 141 and the gate insulating film 142, a source 144 and a drain 145 of the thin film transistor formed of n-type amorphous silicon at both ends of the active layer 143, a source electrode 146 of the thin film transistor formed of a metal on a portion of the source 144 and the gate insulating film 142, a drain electrode 147 of the thin film transistor formed of a metal on a portion of the drain 145 and the gate insulating film 142, a source electrode 146 of the thin film transistor, and an interlayer insulating film (passivation insulating film) 148 composed of the amorphous silicon nitride film or the silicon oxide film on the active layer 143 of the thin film transistor and a portion of the source electrode 146 and the drain electrode 147. Meanwhile, an electron-convergence electrode 149 formed of a metal may be intervened on a portion of the interlayer insulating film 148. The electron-convergence electrode 149 can serve as an optical-shielding film and perform the function of focusing the electrons emitted from the field emitter 130, by applying for a proper voltage. The field emitter 130 may be formed of diamond, diamond like carbon, carbon nanotube, and the like on a portion of the drain electrode 147 of the thin film transistor.

The surface of the gate plate having no gate electrode 230 is adhered to the cathode plate. At this time, said gate plate are arranged in accordance with the field emitter 130 of the cathode plate, the anode plate are separated from the gate plate by using the spacers 400 as the supporter between them. Further, said anode plate is arranged and vacuum packaged against the phosphor 330 of the anode plate and the field emitter 130 of the cathode plate. The spacers 400 serve to keep isolation between the cathode plate/the gate plate and the anode plate. It is not necessarily to be installed in every pixel.

The gate plate includes the gate holes 220 formed by penetrating the glass substrate 210 and the gate electrode 230 made of a metal around the gate holes 220.

The anode plate includes the transparent electrode 320 formed on a portion of the substrate 310, phosphors 330 of red, green and blue formed on a portion of the transparent electrode 320, and a black matrix 340 formed between said phosphors 330.

On the other hand, since the gate plate and the cathode plate can be fabricated separately, the manufacturing process can be readily performed and the gate insulating film in the field emitter fundamentally can be removed. Therefore, the separately fabricated gate plate, the cathode plate and the anode plate are combined together. As a result, it is possible to significantly improve the manufacturing productivity and yield of the field emission display.

Hereinafter, driving principle of the field emission display according to the present invention will be described with reference to FIG. 3 to FIG. 5.

A DC voltage of 50 to 1500V is applied to the gate electrode 230 of the gate plate to induce an electron emission from a film-shaped field emitter 130 of the cathode plate. At the same time, said emitted electrons are accelerated with high energy by applying a high voltage of above 2 kV to the transparent electrode 320 of the anode plate. Meanwhile, an operation of a control device of the field emitter in each pixel of the cathode plate can be controlled, by adjusting the voltages applied to the row signal line 120S and the column signal line 120D of the display. In other words, the control device 140 of the field emitter in each pixel represents an image by controlling an electron emission of the field emitter 130.

At this time, the voltage applied to the gate electrode 230 of the gate plate serves to prohibit electron emission of the field emitter by the anode voltage, and also prevent local arching by forming a relatively uniform potential between the anode plate and the gate plate. The voltage applied to the row signal line 120S and the column signal line 120D of the display is applied to the gate and the source of the thin film transistor. The voltage applied to the gate of thin film transistor may be over 5V to below 50V when the thin film transistor having the active layer formed of amorphous silicon is turned on and below 5V or a negative voltage when the transistor is turned off. Further, the voltage applied to the source may be approximately in the range of 0 to 50 V. The control of the applied voltage, as described above, can be made by an external driver circuit (not shown).

Subsequently, gray scale representation of the field emission display will be described.

Gray scale representation of the common field emission display is implemented using a pulse width modulation (PWM) mode. This is the mode that the duration of the voltage of the data signal applied to the field emitter is controlled to represent gray scale. Wherein, gray scale is represented by the difference in the amount of the electrons emitted for a given time. In other words, if there are plenty of the amounts in the electrons for a given time, a corresponding pixel emits a light having high brightness. However, the mode has a critical limitation where the width (time) of the pulse assigned to the unit pixel is gradually reduced in implementing a large-scale, high-resolution screen. Further, it has a problem that it is difficult to exactly control the amount of emitted electrons.

The driving method according to the present embodiment can overcome the above problems. Gray scale representation of the field emission display may use the pulse width modulation (PWM) mode or the pulse amplitude (PAM) mode separately, or a combination of them. The PAM mode is that gray scale is represented based on the difference of the amplitude applied as the data signal. This mode employs that the amount of the electrons transported to the field emitter may be varied by the difference in the level of the voltage applied to the source in a state where the thin film transistor is turned on. Gray scale can be represented by differentiating the level into two or more levels. This driving method can be applied to implement the large-scale screen and control electrons emission constantly.

Meanwhile, a constant voltage may be applied to the electron-convergence electrode 149 in order to help the electrons emitted from the field emitter 130 of the cathode plate to be well converged on the phosphor 330 of the anode plate, and also, to prohibit field emission of the field emitter 130 by the anode voltage along with the gate electrode 230 of the gate plate. In case of using the electron-convergence electrode 149 as the optical-shielding film, it is possible to prevent the active layer of the thin film transistor 143 from being exposed to the phosphor of the anode plate or surrounding lights.

Now, other embodiments or modifications of the present invention will be described in detail with reference to FIG. 6 to FIG. 8.

Figure 6:
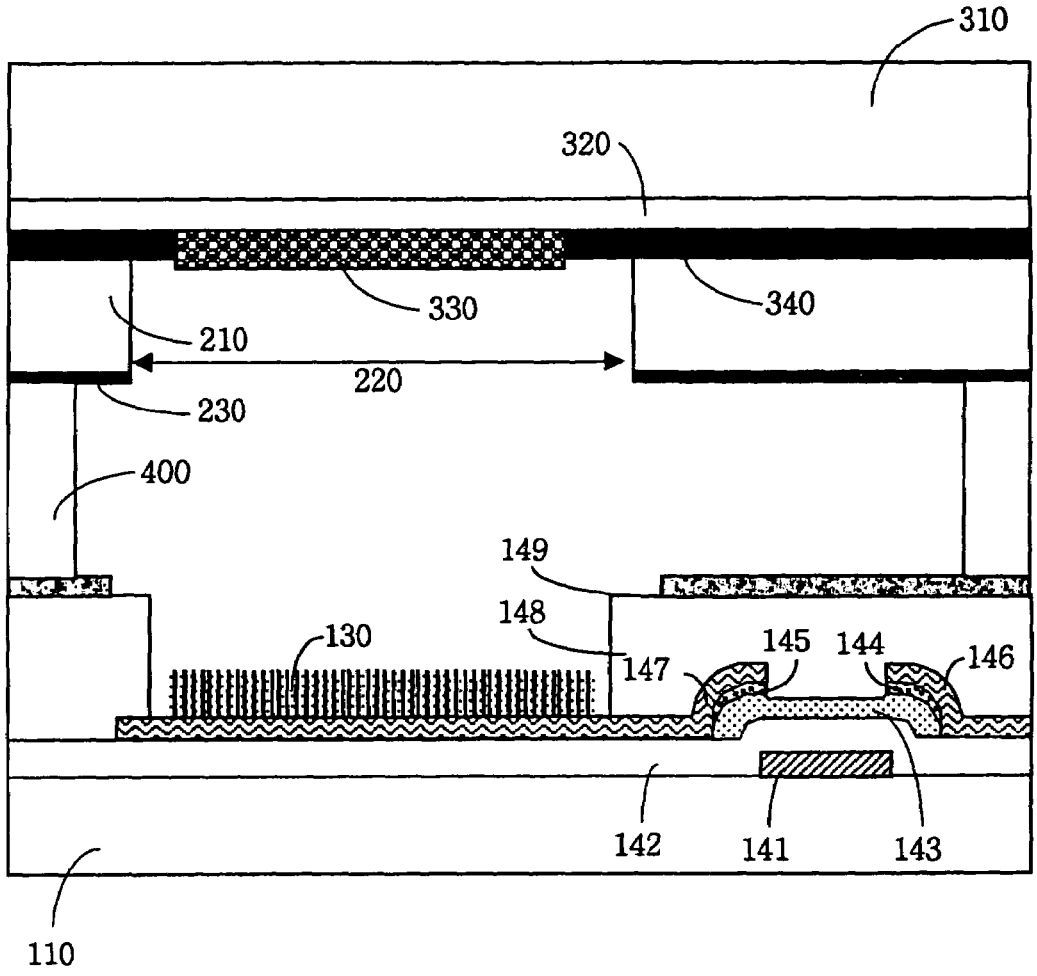
FIG. 6 is a cross-sectional view illustrating the pixel structure of the field emission display according to another embodiment of the present invention.

FIG. 6 is a cross-sectional view illustrating a pixel structure of a field emission display according to another embodiment of the present invention.

The structures of a cathode plate, a gate plate and an anode plate in FIG. 6 are the same as those of FIG. 5, except that the portion into which spacers 400 are inserted is between the gate plate and the cathode plate. In other words, the surface of the gate plate not having a gate electrode 230 is adhered to the anode plate.

Figure 7:
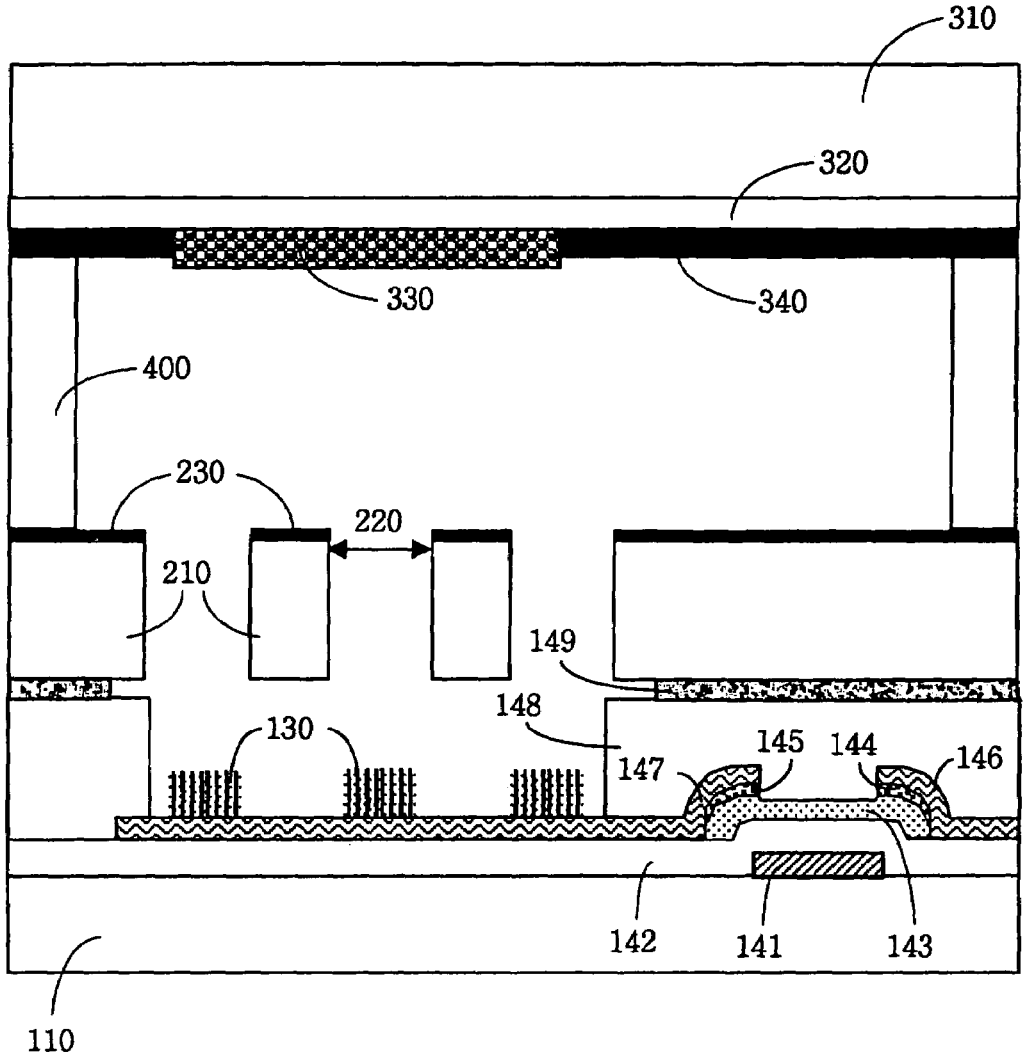
FIG. 7 is a cross-sectional view illustrating the pixel structure of the field emission display according to still another embodiment of the present invention.

FIG. 7 is a cross-sectional view illustrating a pixel structure of a field emission display according to still another embodiment of the present invention.

The structure of the anode plate in FIG. 7 is the same as that of FIG. 5, except that the field emitter 130 of the cathode plate has a plurality of dots and there are many the gate holes 220 of the gate plate so that they are coincident with the number of the dots of the field emitter 130 in the cathode plate. Such a structure has an effective advantage in applying a high voltage to the electrode of the anode plate. In addition, it can prevent the anode electric field from exerting a harmful influence on the field emitter through the plurality of the dots.

Figure 8:
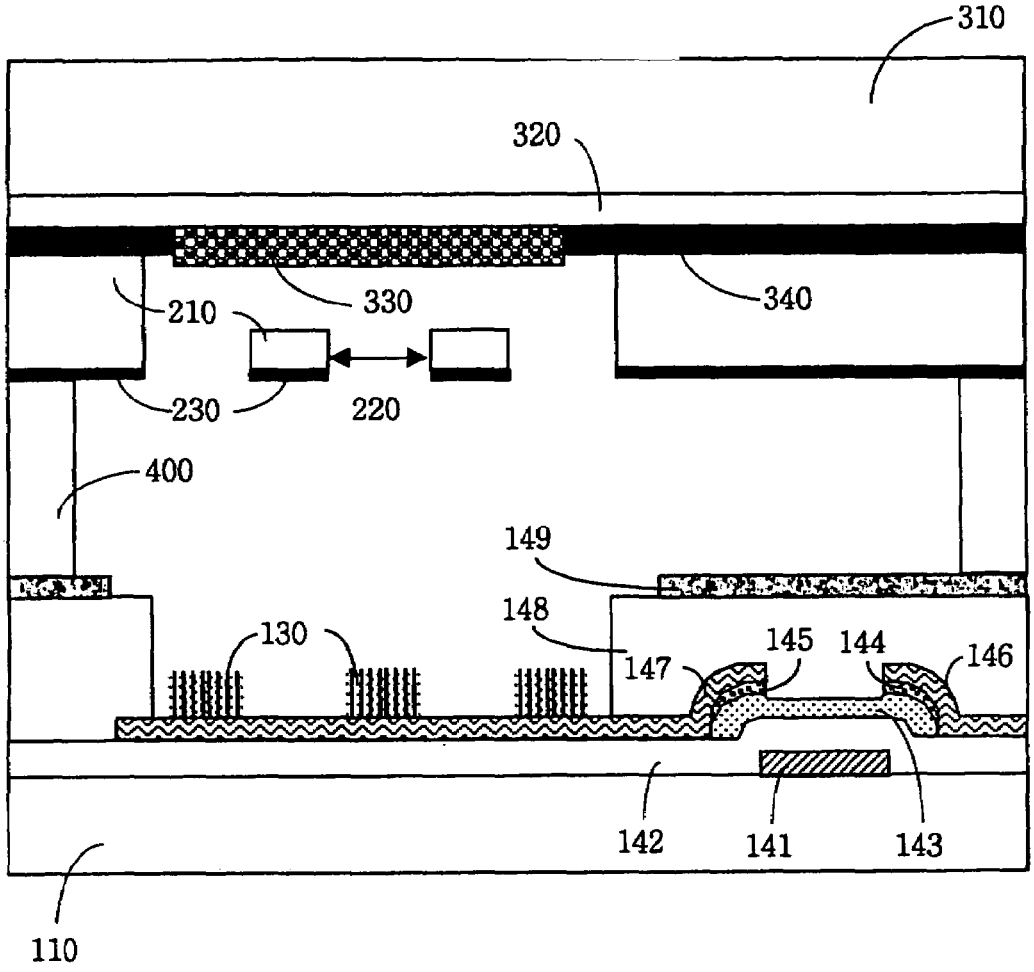
FIG. 8 is a cross-sectional view illustrating the pixel structure of the field emission display according to further still another embodiment of the present invention.

FIG. 8 is a cross-sectional view illustrating a pixel structure of a field emission display according to further another embodiment of the present invention.

The structures of a cathode plate and a anode plate in FIG. 8 are the same as those in FIG. 7, except that gate holes 220 of the gate plate has a dual hole including a larger hole than the phosphor 340 of the anode plate and a small hole corresponding to the field emitter 130 of the cathode plate, the surface of the gate plate having no gate electrode 230 is adhered to the anode plate, and the cathode plate is formed by vacuum packaging in a state where the cathode plate and the gate plate are separated with the spacers supported between them.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

As described above, according to the present invention, a field emission display includes an anode plate consisting of a glass substrate, a cathode plate and a gate plate. The cathode plate includes signal lines for which row/column addressing is possible and pixels each defined by the row/column signal lines, wherein each pixel has a film-shaped field emitter and a control device of the field emitter. Further, the row/column driving voltage of the display can be reduced significantly by inputting and driving scan and data signals of the display to the control device of each pixel. Therefore, a cheap low-voltage driving circuit can be used instead of a high-voltage driving circuit that is required for row/column driving of the conventional field emission display.

Meanwhile, according to the present invention, since the electric field for field emission can be applied through the gate electrode of the gate plate, the distance between the anode plate and the cathode plate can be freely controlled, thereby a high voltage can be applied to the anode. Therefore, the present invention has an advantageous effect that it can significantly increase the brightness of the field emission display. Further, the voltage applied to the gate electrode of the gate plate serves to prohibit electron emission of the field emitter by the anode voltage, and also prevent local arching by forming a relatively uniform potential between the anode plate and the gate plate. Thus the life of the field emission display can be improved significantly.

In addition, since the gate plate and the cathode plate can be fabricated separately and then assembled together, manufacturing process can be readily performed and a breakdown of a gate insulating film in the field emitter can be removed fundamentally. Thus, the present invention can be provided to improve the manufacturing productivity and yield of the field emission display significantly.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A field emission display having a gate plate, comprising:

an anode plate having a transparent electrode on a substrate and a phosphor on a portion of the transparent electrode;

a cathode plate having row/column signal lines of a belt shape for which row/colunm addressing is possible on the substrate, and pixels each defined by the row signal line and the colunm signal line, wherein each pixel has a film-shape field emitter and a control device for controlling the field emitter, having two terminals connected to at least the row/column signal lines and one terminal connected to the film-shape field emitter;

a gate plate fabricated separately from the cathode plate, wherein each pixel of the gate plate has at least one gate hole penetrating therein and a gate electrode surrounding the top of the gate hole; and spacers for supporting the gate plate between the cathode plate and the anode plate, one end of the spacers is in contact with one of the anode plate and the cathode plate, and another end of the spacers is in contact with the gate plate, wherein the field emitter of the cathode plate is constructed to be opposite to the phosphor of the anode plate through the gate holes and is formed by vacuum packaging, wherein each gate hole is an aperture for its enclosed pixel, and the gate plate and the cathode plate are assembled together after being fabricated separately.

2. The field emission display as claimed in claim 1, wherein the anode plate, the cathode plate and the gate plate are formed of different insulating substrates.

3. The field emission display as claimed in claim 1, wherein the spacers are formed between the cathode plate and the gate plate.

4. The field emission display as claimed in claim 1, wherein the spacers are formed between the anode plate and the gate plate.

5. The field emission display as claimed in claim 1, wherein the phosphor of each pixel is the phosphor of red (R), green (G), or blue (B).

6. The field emission display as claimed in claim 1, further comprising a black matrix at a given region between the phosphors of the anode.

7. The field emission display as claimed in claim 1, wherein the field emitter is composed of a thin film or a thick film comprising a diamond, a diamond carbon, or a carbon nanotube.

8. The field emission display as claimed in claim 1, wherein the control device is a thin film transistor or a metal-oxide-semiconductor field effect transistor.

9. The field emission display as claimed in claim 1, wherein the gate electrode is applied to a DC voltage to induce an electron emission from the film-shaped field emitter in the cathode plate;

the emitted electrons are accelerated with high energy by applying the DC voltage to the transparent electrode of the anode plate; and scan and data signals are addressed to the control device of the field emitter in each pixel of the cathode plate, whereby the control device of the field emitter controls the electron emission of the field emitter to represent images.

10. The field emission display as claimed in claim 9, wherein the gate electrode of the gage plate is applied to the DC voltage in the range of 50 to 1500V and the transparent electrode of the anode plate is applied to the DC voltage of over 2 kV.

11. The field emission display as claimed in claim 9, wherein the image is represented by gray scale, by changing the pulse amplitude and/or pulse width (duration) of the data signal voltage applied to the field emitter through controlling of the control device.

12. The field emission display as claimed in claim 11, wherein the voltage of the data signal applied to the field emitter is the pulse in the range of 0 to 50V.

13. The field emission display as claimed in claim 1, further comprising an electron-convergence electrode between the cathode plate and the gate plate.

14. The field emission display as claimed in claim 13, wherein the electron-convergence electrode helps the electrons emitted from the field emitter to be well converged on the phosphor of the anode plate and, further to prohibit the electron emission of the field emitter by the anode voltage along with said gate electrode of the gate plate, by applying the constant voltage to said electron-convergence electrode.

15. The field emission display as claimed in claim 13, wherein the electron-convergence electrode is intended to serve as an optical-shielding film.

16. The filed emission display as claimed in claim 1, wherein the field emitter includes dots divided into a plurality of regions and the gate hole of the gate plate has the number corresponding to each of the dots.

17. The field emission display s claimed in claim 1, wherein the control device is a thin film transistor, which comprises;

a gate made of a metal on the cathode plate;

a gate insulating film formed on the cathode plate including the gate;

an active layer made of a semiconductor thin film on a portion of the gate and the gate insulating film;

a source and a drain formed at both ends of the active layer; and an interlayer insulating layer having a contact hole for connecting the source and the drain to the electrode.

18. The field emission display as claimed in claim 17, further comprising an electron-convergence electrode made of a metal on the interlayer-insulating layer.

19. The field emission display as claimed in claim 17, wherein the active layer of the thin film transistor consists of amorphous silicon or polysilicon layer.

20. The field emission display as claimed in claim 17, wherein the interlayer insulating film consists of an amorphous silicon nitride film or a silicon oxide film. silicon oxide film.

* * * * *